US006588380B2

(12) United States Patent
Ries-Mueller

(10) Patent No.: US 6,588,380 B2
(45) Date of Patent: Jul. 8, 2003

(54) COOLING SYSTEM FOR A MOTOR VEHICLE COMPRISING A CLOSING UNIT FOR THE COOLING AIRFLOW

(75) Inventor: Klaus Ries-Mueller, Bad Rappenau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/018,654

(22) PCT Filed: Mar. 9, 2001

(86) PCT No.: PCT/DE01/00889

§ 371 (c)(1),
(2), (4) Date: Mar. 4, 2002

(87) PCT Pub. No.: WO01/79671

PCT Pub. Date: Oct. 25, 2001

(65) Prior Publication Data

US 2003/0101947 A1 Jun. 5, 2003

(30) Foreign Application Priority Data

Apr. 19, 2000 (DE) ..... 100 19 419

(51) Int. Cl.[7] ..... F01P 7/02
(52) U.S. Cl. ..... 123/41.05; 180/681
(58) Field of Search ..... 123/41.05, 41.04, 123/41.06, 41.07; 180/681

(56) References Cited

U.S. PATENT DOCUMENTS

| | | | |
|---|---|---|---|
| 4,779,577 | A | 10/1988 | Ritter |
| 5,669,311 | A | 9/1997 | Hill |

FOREIGN PATENT DOCUMENTS

| | | |
|---|---|---|
| DE | 44 26 494 A | 2/1996 |
| DE | 195 47 667 A | 6/1997 |
| JP | 10-77838 | 3/1998 |
| WO | 89/04419 | 5/1989 |

*Primary Examiner*—Tony M. Argenbright
*Assistant Examiner*—Katrina B. Harris
(74) *Attorney, Agent, or Firm*—Michael J. Striker

(57) ABSTRACT

The invention proposes a cooling system of a motor vehicle, in which a closure unit for the cooling air stream, in order to optimize the operating parameters of the internal combustion engine, is monitored as to its function. This closure unit, preferably a flap or louver for controlling the cooling air stream, is monitored as to its function in order to prevent a temperature buildup or a failure to reach the operating temperature. In order to monitor the position of the closure unit (1), the invention therefore proposes using a temperature sensor that is as a rule present, to compare the progression of the cooling water temperature to a stored model progression of the temperature. If the cooling water temperature lies within a predetermined tolerance range, then the closure unit is functioning properly. Otherwise, it is assumed that the closure unit is jammed.

10 Claims, 3 Drawing Sheets

COOLING SYSTEM FOR A MOTOR VEHICLE COMPRISING A CLOSING UNIT FOR THE COOLING AIRFLOW

BACKGROUND OF THE INVENTION

The invention is based on a cooling system for a motor vehicle, with a closure unit for the cooling air stream in order to optimize the operating parameters of the internal combustion engine[, as generically defined by the preamble to the main claim]. JP-100 77 838 A has already disclosed a control unit with which the opening angle and/or closing angle of a ventilation flap for the radiator is controlled as a function of the engine temperature. In this connection, a temperature sensor detects the cooling water temperature of the engine and a first computer calculates the time-dependent progression of the temperature change. Based on this, a second computer determines the opening angle to be set for the ventilation flap.

WO 890 44 19 A has disclosed a cooling system for the engine of a motor vehicle in which in addition to the mechanically driven coolant pump, an electrically driven coolant pump can be switched on as a function of the operating parameters. By means of a corresponding ventilation flap, a heat exchanger can be controlled in its capacity so that the cooling performance can increase as the load increases and at high speeds.

With the known cooling system, however, there is the problem that the desired control of the cooling performance depends on the functional reliability of the closure unit, i.e. in particular of the ventilation flap. If the ventilation flap is jammed, which can occur, for example, in winter due to freezing or being coated by snow or ice, then it cannot be assured of reaching its predetermined opening angle. In the extreme case, this can cause the engine to overheat and as a result, lead to engine damage.

SUMMARY OF THE INVENTION

The cooling system of a motor vehicle according to the invention, with a closure unit for the cooling air stream[, which has the characterizing features of the main claim,] has the advantage over the prior art that a misadjustment of the closure unit is detected by means of the temperature progression. In this connection, it is particularly advantageous that no additional sensor is required for detecting the opening angle of the closure unit. This reduces costs.

Advantageous modifications and improvements of the cooling system [disclosed in the main claim] are possible [by means of the measures taken in the dependent claims]. It is particularly advantageous that a tolerance range is provided for the progression of a model temperature so that then, by means of a simple comparison to the actual temperature, a temperature difference is detected and the cause can be sought. If the closure unit is opened, for example, although the engine temperature is too low, then it can be concluded from this that the opening angle for the closure unit is too great. On the other hand, fi the engine temperature is too high, then it can be assumed that the closure unit is closed so that the cooling air stream is insufficient.

If a misadjustment of the closure unit is suspected based on the above criteria, then in order to support this thesis by means of an intentional adjustment of the opening angle of the closure unit and control of the corresponding temperature progression, a test can once again be made as to whether the suspected cause lay in the adjustment of the opening angle of the closure unit. For the sake of simplicity, this is possible with a second tolerance range, for which a corresponding model progression is stored, so that the suspected misadjustment can be checked by means of a simple plausibility test.

The model progression for the cooling water temperature is advantageously determined empirically for a particular motor vehicle type or engine type so that this model is supported by the results of actual practice.

It is also favorable to store the model progression, along with its parameters, in a nonvolatile memory so that they are available even after a power failure.

It has also turned out to be favorable to select a closure unit for storage, which is produced, for example, from a butterfly valve or a louver. These parts are easy to manufacture and can be controlled, for example, with small electric motors.

BRIEF DESCRIPTION OF THE DRAWINGS

An exemplary embodiment of the invention is shown in the drawings and will be explained in detail in the description that follows.

DESCRIPTION OF THE PREFERRED EMBODIMENTS

Figure 1:
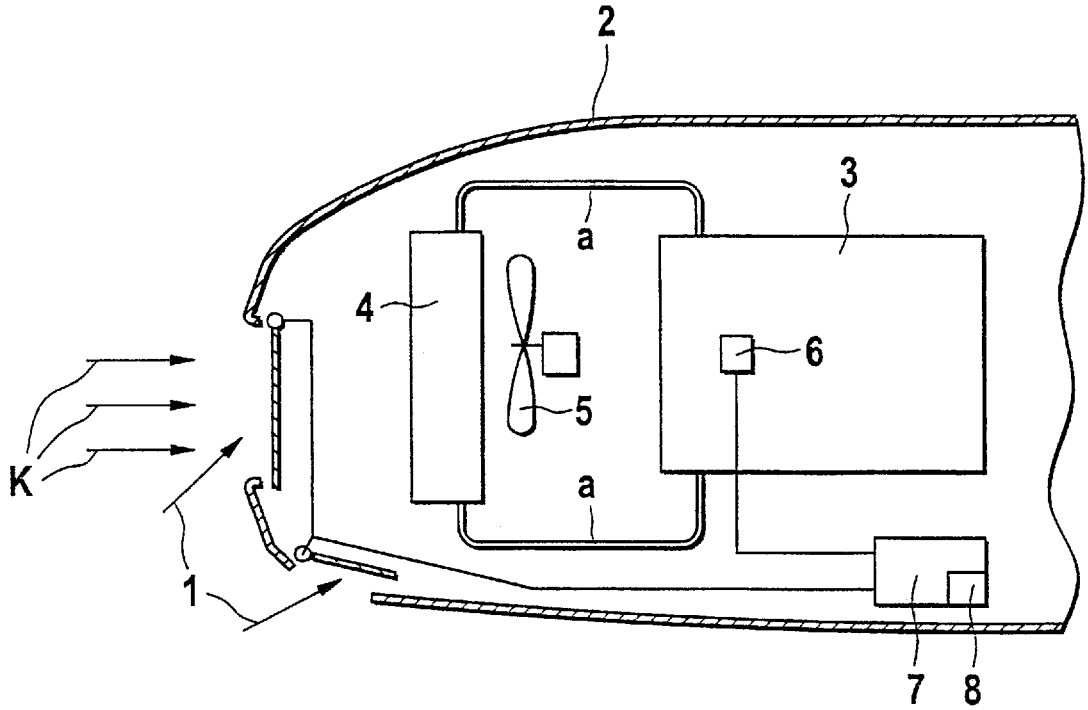
FIG. 1 shows a schematic representation of a closure unit for an engine compartment.

FIG. 1 schematically depicts an engine compartment 2, which is essentially completely encapsulated and has openings for the cooling air flow K oriented in the travel direction. The openings are embodied with suitable closure units 1, for example flaps or louvers. At least one radiator 4 is situated in the engine compartment 2, with a correspondingly provided fan 5 that draws the cooling air stream K through the radiator 4 and consequently dissipates the stored heat from the radiator 4. By means of openings that are not shown, the heated air stream is conveyed either into the open air or is optionally used to heat the passenger compartment of the motor vehicle. There is also an engine 3 embodied as an internal combustion engine, which has at least one sensor 6 for measuring the temperature of the cooling water. The engine 3 is connected to the radiator 4 via suitable radiator hoses. The required valves, pumps, etc. have been omitted for the sake of visibility.

A control unit 7 with a nonvolatile memory 8 is also disposed in the engine compartment 2. The control unit 7 is connected to the sensor 6 via cable. There is also a control connection for actuation motors, not shown, of the closure units 1. The closure units are disposed so that depending on the engine temperature or the cooling water temperature, they can be opened or closed or can assume intermediary positions so that the cooling air stream K for cooling the radiator 4 and the engine 3 can be regulated. Thus, for example in the event of a cold start, the cooling air stream K can be suppressed in order to cause the engine to warm up more quickly. The quicker warm-up of the engine produces fewer polluting emissions and rapidly achieves of an optimal operating point of the engine.

In order to execute a thermal management, it is necessary that the closure unit 1 function reliably under all operating conditions. Particularly in winter, with low temperatures and when there is ice and snow, it is necessary that the closure unit 1 always have the desired opening angle. When the engine is heavily loaded and there is a high amount of heat being produced, a closed closure unit 1 could cause the engine to overheat and as a result, lead to engine damage. On the other hand, a constantly open flap can prevent the engine from reaching its optimal operating temperature and consequently producing above average amounts of pollutants in its exhaust. In this case, the heat output would naturally also be insufficient for heating the passenger compartment. Monitoring the functioning of the closure unit 1, could also be required by law.

Figure 2:
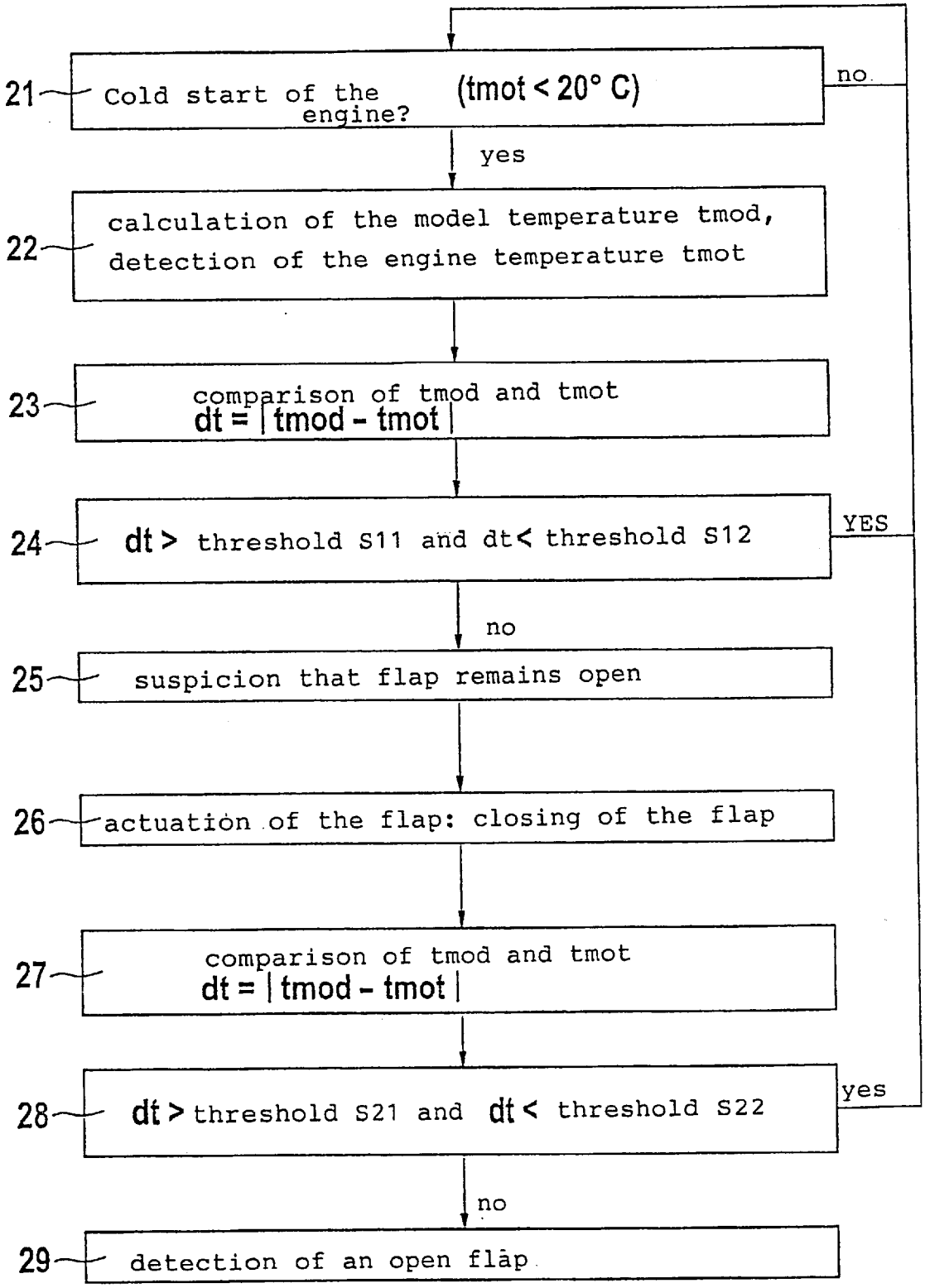
FIG. 2 shows a flowchart.

The monitoring of the opening angle of the closure unit 1 thus takes place according to the invention with a regulation of the type that is explained in detail in conjunction with FIG. 2. In this connection, it is assumed that a model progression for the cooling water temperature is stored in the memory 8 and this model progression takes into account the temperature increase both when the closure unit 1 is closed and when it is open. The invention then assumes that with a suspected malfunction of the closure unit 1, the actual temperature progression for the cooling water temperature does not coincide with the stored model progression. In order to test this assumption, the closure unit 1 is intentionally actuated so that the resulting change in the cooling air stream K must also produce a change in the temperature progression. Naturally, driving conditions, engine load, and/or heat production of the engine must be taken into account here.

According to the flowchart of FIG. 2, in position 21, the sensor 6 is used to check whether the engine is being started cold. If the temperature of the engine is less than 20° C., for example, then it is assumed that it is being started cold. In this case, in position 22, the model temperature tmod is taken from the memory 8 and is compared to the measured engine temperature tmot.

If a cold start is being executed, the comparative temperature difference dt between the model temperature tmod and the engine temperature tmot at time t1 is calculated in position 23. If the temperature difference dt lies between the two predetermined thresholds S11 and S12, which represent a corresponding temperature tolerance range, then the value is acceptable (position 24). In this instance, it can be assumed that the closure unit 1 is functioning properly. In this instance, the program goes back to position 21 and restarts the temperature measurement. However, if the temperature difference dt lies outside the two thresholds S11 and S12, then it is assumed that the closure unit 1 is open (position 25). In this instance, according to position 26, the control unit 7 actuates the flap and for example adjusts it by a particular angle or closes it completely. In position 27, the comparative temperature difference dt between the model temperature tmod and the engine temperature tmot is calculated again at time t2. According to position 28, if the temperature difference dt now lies between the second thresholds S21 and S22, then it is assumed that the closure unit 1 is functioning properly and there is no malfunction. In this case, then the program goes back to position 21.

On the other hand, if the temperature difference dt lies outside the two thresholds S21 and S22, then it is assumed that the closure unit 1 cannot be actuated. In this instance, the program identifies an open flap as a misadjustment (position 29). This state can now be indicated, for example, on a display on the dashboard and can thus notify the driver that the cooling system is not functioning properly. Alternatively, this malfunction is stored in a malfunction memory so that it can be diagnosed when serviced at a repair shop.

Figure 3:
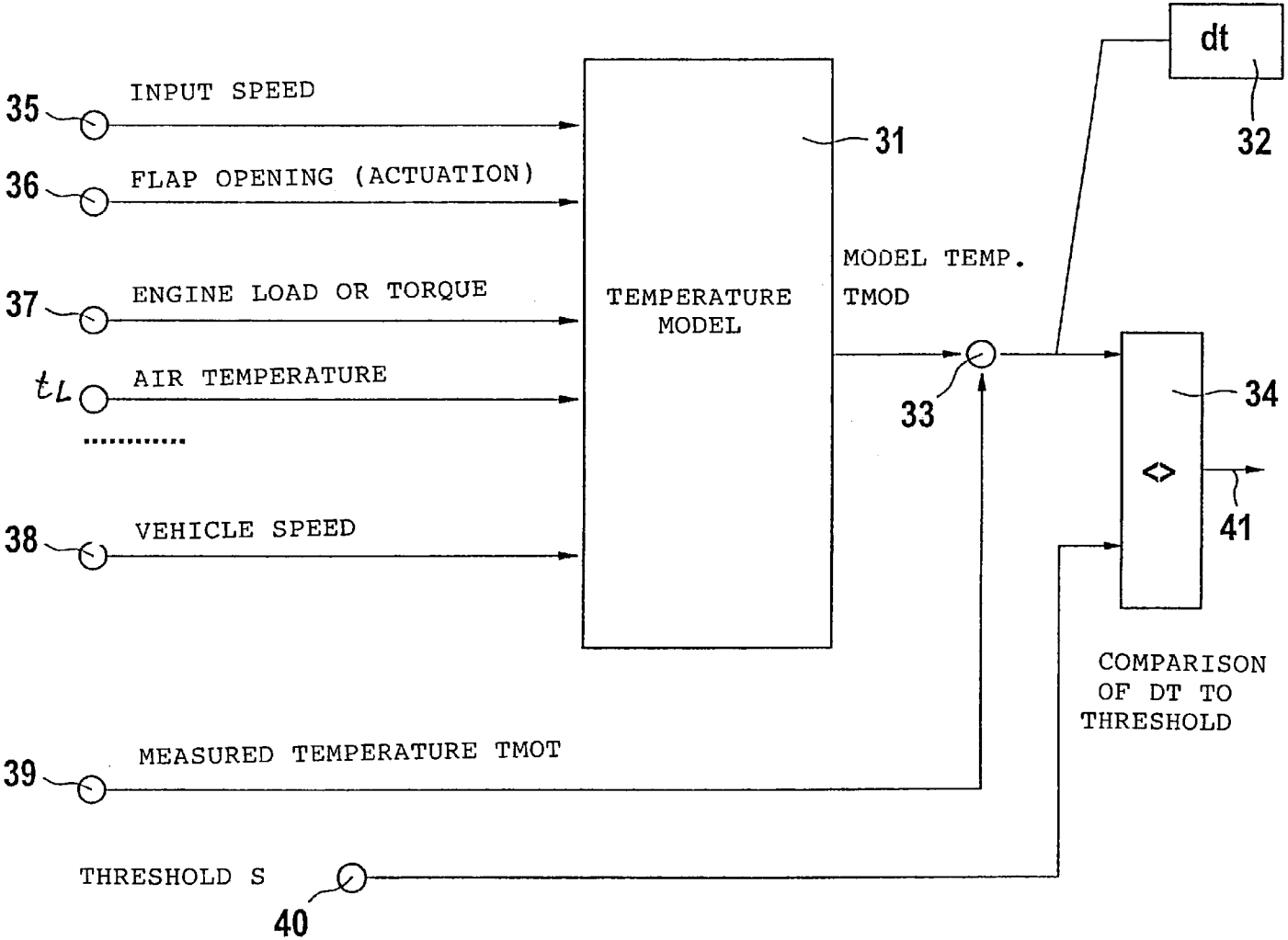
FIG. 3 shows a block circuit diagram.

FIG. 3 shows a block circuit diagram for calculating the model temperature tmod, the engine temperature tmot, and the temperature difference dt. A temperature model 31 is produced for the motor vehicle, into which all variable engine and driving parameters are taken into account. Thus, for example, the input speed of the engine, the actuation value for the flap opening, the engine load and/or engine torque, the air temperature $t_L$, and/or the vehicle speed, are input into corresponding inputs 35 to 38. These data are already supplied by means of corresponding sensors and can consequently be taken into account for the calculation of the temperature model 31. The model temperature tmod is then supplied on the output side. This model temperature tmod is sent to a subtracter 33, which subtracts the measured temperature tmot that has been supplied, for example, by the sensor 6 via a terminal 39. On the output side, the subtracter 33 supplies the temperature difference dt (position 32). This temperature difference dt is sent to a comparator 34, which is correspondingly supplied with the thresholds S11, S12, S21, and S22 via the input 40. The comparator 34 compares the temperature difference dt to the tolerance ranges of the thresholds S and sends a corresponding output signal to the terminal 41. This output signal can then be processed further.

A closed, jammed flap can thus be diagnosed. In this connection, the temperature progression after the actuation and/or opening of the flap can serve as a reference point. After the flap is actuated, if the engine temperature tmot increases more sharply than the model temperature tmod (dt>S31 and dt<S32 at time t3), then a closed, jammed flap is suspected. If this is still the case after the flap is actuated again, then it can be concluded that the flap is actually closed and jammed.

The actuation of the flap with a subsequent comparison of the temperatures tmot and tmod can also take place purely for testing purposes (without the prior suspicion of a malfunction). This then advantageously takes place in the quasi-stationary motor operation, for example at idling speed.

What is claimed is:

1. A cooling system of a motor vehicle, with a closure unit (1) for the cooling air stream (K) in order to optimize the operating parameters of the internal combustion engine (3), having a sensor (6) for detecting the engine temperature (tmot) and a control unit (7) for actuating the closure unit (1) as a function of the engine temperature (tmot), characterized in that the control unit (7) is designed to detect the chronological temperature progression for the cooling water and to compare it to a predetermined model progression, and that the control unit (7) detects a misadjustment of the closure unit (1) from the chronological change of the temperature difference (dt) between the model progression (tmod) and the cooling water temperature progression (tmot).

2. The cooling system according to claim 1, characterized in that the control unit (7) detects a misadjustment of the closure unit (I) when there is a progression of the chronological temperature difference (dt) between the cooling water temperature (tmot) and the model temperature (tmod) that falls outside a predetermined tolerance range (S11, S12).

3. The cooling system according to claim 1, characterized in that when the misadjustment is detected, the control unit (7) actuates the closure unit (1) by a predetermined angle and then compares the temperature progression to the model progression for a predetermined time interval.

4. The cooling system according to claim 3, characterized in that the temperature progression produced is compared to a second tolerance range (S21, S22) and is tested for plausibility.

5. The cooling system according to claim 1, characterized in that the model progression for the cooling water temperature can be empirically determined for a vehicle/engine type.

6. The cooling system according to claim 5, characterized in that the model progression is stored in a nonvolatile memory (8) of the control unit (7) or is calculated based on parameters that are stored in a nonvolatile manner.

7. The cooling system according to claim 1, characterized in that the closure unit (1) has a butterfly valve.

8. The cooling system according to claim 1, characterized in that the closure unit (1) has a louver.

9. The cooling system according to one of the preceding claims, characterized in that the closure unit (1) is actuated during a favorable, quasi-stationary operation of the engine.

10. The cooling system according to claim 9, characterized in that the closure unit (1) is actuated during a favorable, quasi-stationary operation of the engine when idling while the vehicle is stationary.

* * * * *